United States Patent [19]

Rakitsch et al.

[11] 4,428,038

[45] Jan. 24, 1984

[54] DISTRIBUTED LIGHT REFLECTOR

[75] Inventors: Peter Rakitsch, Ismaning; Albert Bodmer, Munich, both of Fed. Rep. of Germany

[73] Assignee: Patent-Treuhand-Gesellschaft für Elektrische Glühlampen mbH, Munich, Fed. Rep. of Germany

[21] Appl. No.: 275,150

[22] Filed: Jun. 19, 1981

[30] Foreign Application Priority Data

Jul. 22, 1980 [DE] Fed. Rep. of Germany ..... 3027774

[51] Int. Cl.[3] ..... F21V 7/00

[52] U.S. Cl. ..... 362/263; 362/299; 362/304; 362/346; 362/347

[58] Field of Search ..... 362/346, 347, 348, 350, 362/297, 304, 263

[56] References Cited

U.S. PATENT DOCUMENTS 3,688,149 8/1972 Pitkjaan ..... 362/346

4,208,704 6/1980 Draper ..... 362/346

4,218,727 8/1980 Shemitz ..... 362/350

*Primary Examiner*—Donald P. Walsh

*Attorney, Agent, or Firm*—Frishauf, Holtz, Goodman & Woodward

[57] ABSTRACT

To provide for uniformity of illumination across a film window, for example for super-8 mm film, the reflector has at least two contours whose generatrices follow conical sections which have a common optical axis in the direction of radiation emission, and which are so arranged that the sections are formed as sectors, with adjacent sectors having different contours. At least four sectors are used, and preferably the focal point of the generatrices are displaced relative to each other either in the reflector axis or on a parallel thereto, the conical section are identical, and two such conical sections are used, with surface areas at a ratio of between 4:6 or about even.

21 Claims, 5 Drawing Figures

DISTRIBUTED LIGHT REFLECTOR

CROSS REFERENCE TO RELATED APPLICATIONS

U.S. Ser. No. 275,151, filed June 19, 1981, BODMER, assigned to the assignee of the present application.

Reference to related U.S. Pat. Nos.:

U.S. Pat. No. 4,021,659

U.S. Pat. No. 4,035,631 and to

German Patent Disclosure Documents:

DE-OS No. 21 48 478 to which U.S. Pat. No. 3,758,770 corresponds

DE-OS No. 23 63 378 to which U.S. Pat. No. 3,825,742 corresponds

The invention relates to a reflector which is used for illuminating an area, for instance for use in a film projection system to illuminate a screen in the projection system through a film window and to a lamp reflector combination to provide illumination.

BACKGROUND

When using a luminous element of finite size, for instance a filament of an electric bulb, e.g. a halogen cycle incandescent lamp, in combination with a smooth reflector surface, local brightness variations occur in the film of a projector window due to the filament image. For this reason, it has been proposed to roughen the reflector surface by punching or facetting. A reflector having a surface of numerous small reflective areas is described for instance in U.S. Pat. No. 4,021,659 and U.S. Pat. No. 4,035,631. Other surface structures are described, among others, in German Disclosure Documents DE-OS No. 21 48 478 and DE-OS No. 23 63 378 to which U.S. Pat. Nos. 3,758,770, Morasz and 3,825,742, Levin correspond. The structures of the reflector surfaces described cause the beams to become fanned out or spread more than with a smooth reflector surface. Thus, the filament structure in the film window is blurred; non-uniformities in the film window illumination remain nevertheless. As a result of increased stray light, the utilizable light flux drops, and this has to be compensated by increasing the power input of the lamp; this, in turn, causes a higher temperature in the film window than with smooth reflector surfaces. The common feature of all these solutions is that the reflectors have one contour only.

THE INVENTION

It is an object to provide a reflector with a surface by which a good uniformity of the film window illumination may be obtained and stray light is avoided as far as possible, and more particularly to provide light for "Super 8" film windows.

Briefly, the reflector comprises at least two contours whose generatrices follow elliptical curves, i.e. sectional cuts through a cone, having a common optical axis in the direction of radiation emission; further, more than three sectors are provided, with adjacent sectors having a different contour with respect to the position of the filament.

The focal points of the elliptical sections may coincide or may be displaced relatively to each other in the reflector axis or on a parallel to the reflector axis. This displacement should preferably be less than the dimension of the luminous element. Depending on the use of the reflector, the generatrices of the contours may follow identical or non-identical elliptical sections. The parts forming the different contours should preferably be present with about equal surface areas, or their surface areas should not differ more than by a ratio of 40:60 in order to obtain the most favorable total illumination curve. For the symmetry of the optical rendering, an even number of sectors is to be preferred, especially when the number of sectors is low. For the same reason, the sequence of the sectors of different contours is preferably always to be arranged in the same way.

By matching the different contours of the elliptical sectors to one another, for instance such that the contour of one sector provides to a spot-type illumination, and the contour of the other sector provides a saddle-type illumination, a highly uniform illumination of the film window may be achieved.

The reflector shapes of the invention which reflect the image of the luminous element by means of several reflector contours into the film window have improved light uniformity both in projection and in illumination. The decisive factor is that, in projection, the uniformity of the 1st order is improved over the entire projection screen and not only the uniformity of the 2nd order, i.e. ripple or spot variations of the film window illumination, as compared to the initially described reflectors which have numerous small reflective areas on one contour.

The uniformity of illumination of the 1st order describes the shape of the illumination intensity across the projection screen with respect to the basic shape of the light distribution curve; the uniformity of the 2nd order describes, within the basic shape, the slight variations in illumination which are caused by images of lamp structure or other attendant phenomena in the film window. An explanation for this improvement may be that a reflector whose contour corresponds to a single elliptical equation can always primarily project only one object point into one image point. When, for instance, two contours are used, two object points may be projected into one image point, or one object point may be projected into two image points. When several contours are used, a corresponding number of associations of object point/image point may be determined. The contours may be distributed over the reflector in an arbitrary arrangement. It is important, however, that the overall length of the boundaries of the reflector contours has a minimal value and the slanting mold surfaces for the blank used in manufacture of the reflector require but a small angle with respect to the reflector axis. These requirements are met extremely well by an arrangement of the contours in sectors.

DRAWINGS

Figures 3A, 3B, 3C:
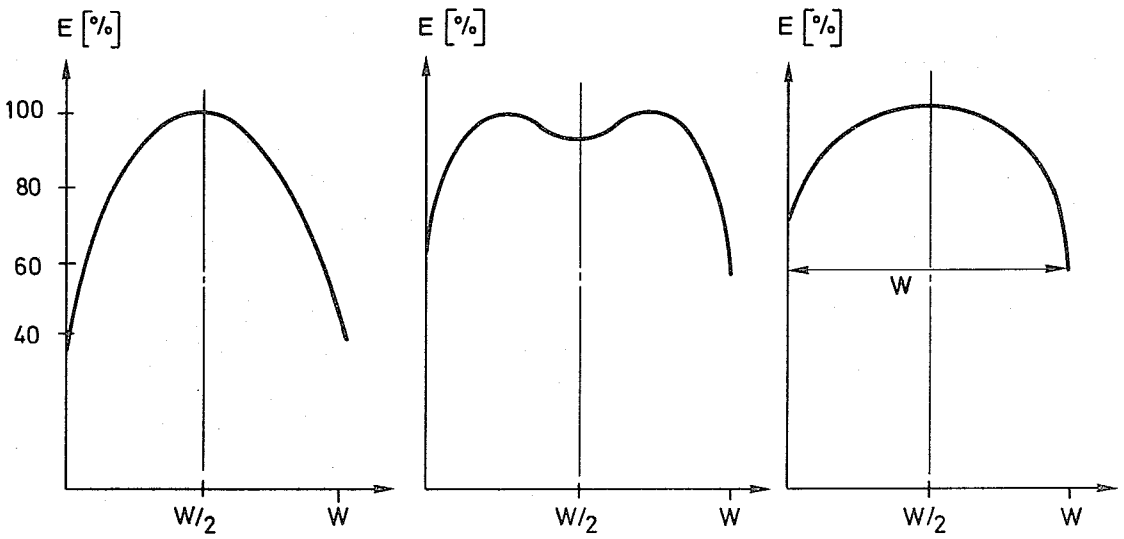

FIGS. 3*a* to 3*c* are graphs of the relative illumination intensity distribution.

Figure 1:
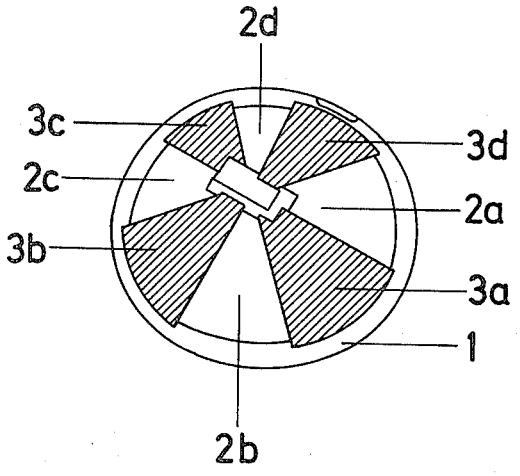
FIG. 1 is a perspective top view of the reflector.
Figure 2:
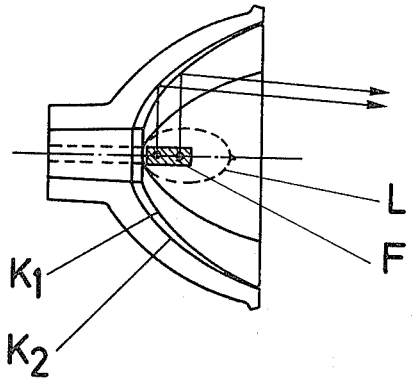
FIG. 2 is a section through the reflector.

The reflector 1 is, preferably, made of a borosilicate glass and is divided into eight sectors. The four sector areas 2*a*–2*d* have a contour $K_1$. The alternately arranged sector areas 3*a*–3*d* associated therewith belong to a different contour $K_2$. The path of rays is illustrated in FIG. 2. FIG. 3*a* shows the illumination intensity distribution of contour 1 which yields a spot-type illumination. Here and in the following FIGS. 3*b* and 3*c*, W denotes the widest dimension of the area to be illuminated. FIG. 3*b* shows the illumination intensity distribution of contour 2 which yields a saddle-type illumination characteristic of the film window. In FIG. 3*c* is plotted the composite illumination curve generated by the reflector which is composed of the two contour parts. The improved distribution is apparent from FIG. 3*c*. The relative illumination intensity in percent is plotted on the ordinate.

In the present example, the parts having the different contours have a surface area ratio of 50:50. The widest dimension of the area to be illuminated, for example of a film window, is shown by the arrow W in FIG. 3*c*, from which the essential uniform illumination obtained throughout its dimension will be apparent.

Reflectors of this type having several contours are suited for lamps with small luminous elements, large film window and the use of only slightly opened objectives. Good results are obtained, for instance, with the following embodiments:

EXAMPLE 1

The reflector comprises two sectorially arranged contours, in which the contours follow non-identical elliptical curves. The outer reflector diameter is 54 mm. The equation for the contour $K_1$ is $$0.442359X^2-0.276790XY+Y^2+31.353331X-17.448185Y+294.045=0,$$

the equation for the contour $K_2$ is $$0.580390X^2+2.997111XY+Y^2-49.93828X+214.9997Y-5171.662=0,$$

with the origin of the coordinates in the center of the film window. The optical mounting distance is 38.4 mm, the film window is 4.01×5.36 mm (super 8), the image forming objective is 1:1.3/20.

The lamp bulb used, preferably incorporated in the reflector is a 250 W metal halide discharge lamp, e.g. a HMI (Trademark) 250 W lamp of medium arc length which comprises at each electrode tip a punctiform plasma globule and whose luminous field size has a diameter of 0.8×2.5 mm.

EXAMPLE 2

The reflector has sectorially arranged contours in which the generatrices of the contours follow identical elliptical sections, and wherein the focal points are displaced relatively to one another in the reflector axis, which is identical with the optical axis. The displacement in the example is 0.8 mm; the equation for the contour $K_1$ is $$0.460689X^2+0.043947XY+Y^2+11.372674X+0.841685Y-264.971606=0,$$

the equation for the contour $K_2$ is $$0.460689X^2+0.043947XY+Y^2+12.109777X+0.876842Y-255.578625=0,$$

the outer reflector diameter is 35 mm, the optical mounting distance is 27.1 mm, the film window to be illuminated is 4.14×5.69 (super-8), and the image objective is f 1:1.5/10. The lamp bulb used, preferably incorporated in the reflector is a halogen cycle incandescent lamp of 8 V 20 W having a filament size whose diameter is 0.9×1.4 mm.

The lamp bulb L is shown only schematically in FIG. 2, positioned with its filament F on the optical axis including the focal planes of the two contours.

We claim:

1. A reflector for illuminating an area from a source of emission of radiation comprising at least four sector-shaped sections having contours whose generatrices follow elliptical curves having a common optical axis in the direction of radiation emission, adjacent sectors having a different contour with respect to said source, wherein the focal points of the elliptical curves coincide and the contour of the one elliptical section being such that a spot-type illumination results, and the contour of the other elliptical section being such that a saddle-type illumination is obtained; and wherein said contours follow the equations:

$$0.442359X^2-0.276790XY+Y^2+31.353331X-17.448185Y+294.045=0$$

$$0.580390X^2+2.997111XY+Y^{22}-49.93828X+214.9997Y-5171.662=0.$$

2. A reflector as claimed in claim 1, wherein the sectors having the different contours are present with the same surface area.

3. A reflector as claimed in claim 1, wherein the sectors having the different contours have surface areas which differ from each other up to a ratio of 40:60.

4. A reflector as claimed in claim 1, wherein the sequence of the sectors of different contours is always the same.

5. A reflector-lamp combination comprising a halogen cycle incandescent bulb which forms said source, and a reflector as claimed in claim 1 secured to said bulb.

6. A reflector for illuminating an area from a source of emission of radiation comprising at least four sector-shaped sections having contours whose generatrices follow elliptical curves having a common optical axis in the direction of radiation emission, adjacent sectors having a different contour with respect to said source, the focal points of the elliptical curves are displaced relatively to each other on a parallel to the reflector axis, the contours of the elliptical curves are identical; and wherein the contours follow the equations:

$$0.460689X^2+0.043947XY+Y^2+11.372674X+0.841685Y-264.971606=0$$

$$0.460689X^2+0.043947XY+Y^2+12.109777X+0.876842Y-255.578625=0.$$

7. A reflector as claimed in claim 6, wherein the focal points of the elliptical curves are displaced relatively to each other in the reflector axis.

8. A reflector as claimed in claim 6, wherein the focal points of the generatrices are displaced relatively to each other by a dimension that is smaller than that of the source.

9. A reflector as claimed in claim 6, wherein the sectors having the different contours are present with the same surface area.

10. A reflector as claimed in claim 6, wherein the sectors having the different contours have surface areas which differ from each other up to a ratio of 40:60.

11. A reflector as claimed in claim 6, wherein the sequence of the sectors having displaced focal points is always the same.

12. A reflector-lamp combination comprising a halogen cycle incandescent bulb which forms said source, and a reflector as claimed in claim 6 secured to said bulb.

13. A reflector as claimed in claim 7, wherein the focal points of the generatrices are displaced relatively to each other by a dimension that is smaller than that of the source.

14. A reflector as claimed in claim 7, wherein the sectors having the different contours are present with the same surface area.

15. A reflector as claimed in claim 7, wherein the sectors having the different contours have surface areas which differ from each other up to a ratio of 40:60.

16. A reflector-lamp combination comprising a halogen cycle incandescent bulb which forms said source, and a reflector as claimed in claim 7 secured to said bulb.

17. A reflector-lamp combination comprising a halogen cycle incandescent bulb which forms said source, and a reflector as claimed in claim 8 secured to said bulb.

18. A reflector-lamp combination comprising a halogen cycle incandescent bulb which forms said source, and a reflector as claimed in claim 3 secured to said bulb.

19. A reflector-lamp combination comprising a halogen cycle incandescent bulb which forms said source, and a reflector as claimed in claim 10 secured to said bulb.

20. A reflector as claimed in claim 1, wherein the outer diameter of the reflector is 5.4 cm.

21. A reflector as claimed in claim 7, wherein the outer diameter of the reflector is 3.5 cm.

* * * * *